US007530247B2

(12) United States Patent
Lai et al.

(10) Patent No.: US 7,530,247 B2
(45) Date of Patent: May 12, 2009

(54) DEVICE FOR HYDROFORMING METAL ELEMENTS

(75) Inventors: Manuel Lai, Orbassano (IT); Valter Stillio, Leini (IT); Rosanna Brun, Orbassano (IT); Marco Colosseo, Orbassano (IT)

(73) Assignee: C.R.F. Società Consortile per Azioni, Orbassano (Turin) (IT)

( * ) Notice: Subject to any disclaimer, the term of this patent is extended or adjusted under 35 U.S.C. 154(b) by 0 days.

(21) Appl. No.: 12/117,511

(22) Filed: May 8, 2008

(65) Prior Publication Data

US 2008/0282757 A1 Nov. 20, 2008

(30) Foreign Application Priority Data

May 15, 2007 (EP) ..... 07425279

(51) Int. Cl.
*B21D 26/08* (2006.01)

(52) U.S. Cl. ..... 72/56; 72/60

(58) Field of Classification Search ..... 72/56, 72/57, 58, 60, 63; 29/421.1
See application file for complete search history.

(56) References Cited

U.S. PATENT DOCUMENTS

| | | | | |
|---|---|---|---|---|
| 3,820,369 | A * | 6/1974 | Tominaga et al. | 72/58 |
| 4,024,744 | A * | 5/1977 | Trakhtenberg et al. | 72/56 |
| 6,018,971 | A * | 2/2000 | Kleinschmidt | 72/61 |
| 7,124,618 | B1 * | 10/2006 | Ghiran et al. | 72/60 |
| 7,251,973 | B2 * | 8/2007 | Gharib | 72/61 |
| 2007/0056341 | A1 | 3/2007 | Gharib | |

FOREIGN PATENT DOCUMENTS

| | | |
|---|---|---|
| DE | 198 58 837 A1 | 6/2000 |
| EP | 0 940 199 A2 | 9/1999 |
| EP | 1 166 913 A2 | 1/2002 |
| JP | 2002035852 | 2/2002 |
| JP | 2004276077 | 10/2004 |

OTHER PUBLICATIONS

European Search Report for corresponding European Patent Application No. 07425279.2, dated Nov. 5, 2007.

* cited by examiner

*Primary Examiner*—David B Jones
(74) *Attorney, Agent, or Firm*—Heslin Rothenberg Farley & Mesiti P.C.; Victor A. Cardona, Esq.

(57) ABSTRACT

A hydroforming device includes a top die and a bottom die, set between which is a metal element to be formed and which are pressed against one another during a hydroforming process. A relative movement of the two dies between the open condition and the closed condition is controlled by a hydraulic cylinder. The opening of the two dies during the hydroforming process, when the forming cavity is filled with liquid at a high pressure, is prevented by applying on the two dies a force generated by means of two wedge-shaped members, which are horizontally mobile, controlled by respective actuator means and having inclined surfaces in contact with corresponding inclined surfaces of a vertically mobile member. The mobile member and the hydraulic cylinder are set operatively in series between one and the same die of the two dies and the base of the hydroforming cell. On the opposite side, the two dies rest against a top cross member of the fixed structure of the hydroforming cell, which is rigidly connected to the base by means of two shoulders so that the vertical forces that are generated during the hydroforming process are discharged on the shoulders, which are subject to tensile stress.

8 Claims, 2 Drawing Sheets

DEVICE FOR HYDROFORMING METAL ELEMENTS

CROSS REFERENCE TO RELATED APPLICATIONS

This application claims priority from European patent application No. 07425279.2, filed on May 15, 2007, the entire disclosure of which is incorporated herein by reference.

BACKGROUND OF THE INVENTION

The present invention relates to devices for hydroforming metal elements and regards in particular a device of the type comprising:

- a hydroforming cell, having a fixed rigid structure including:
  - a base;
  - a top cross member surmounting the base and set at a distance therefrom; and
  - two shoulders, which connect the top cross member rigidly to the base; and
- a hydroforming module set within the cell between said base and said top cross member so that the vertical forces that are generated during the hydroforming process are discharged on said shoulders, which are subject to tensile stress,
- said hydroforming module comprising:
- a top die and a bottom die, which can be displaced vertically with respect to one another between an open condition and a closed condition, in which they define between them a forming cavity for a metal element set between them;
- means for supplying a liquid under pressure within said forming chamber; and
- means for controlling the relative vertical movement of the two dies, said means comprising:
  - at least one vertical hydraulic cylinder set between one of said dies and the fixed structure of the cell; and
  - a pair of wedge-shaped members set opposite to one another, which can be displaced by means of activator means synchronously with respect to one another on a horizontal supporting surface of the fixed structure of the cell, for causing the vertical movement of a controlled member, which is operatively connected to one of said dies.

A hydroforming device having all the characteristics referred to above is described and illustrated in the document No. JP-A-2004276077.

In traditional hydroforming devices, the top die and the bottom die are pressed against one another by means of a press. Obviously, since the pressure of the hydroforming liquid, during the hydroforming process is relatively high, the force that must be applied by the press becomes very high in the case of forming of large panels of sheet metal, such as for example panels of sheet metal for the bodies of motor vehicles. Consequently, said conventional devices entail the use of very powerful presses of very large dimensions. Said drawback exists also in the case of the device illustrated in the document No. JP-A-2004276077 in so far as, in said device, the aforesaid wedge-shaped members are used for setting the top die and the bottom die up against one another, whilst two vertical hydraulic cylinders are provided that are kept active to resist the high vertical force that is generated during the operation of hydroforming as a result of the pressure of the hydroforming liquid between the two dies.

SUMMARY OF THE INVENTION

The purpose of the present invention is to overcome the drawbacks mentioned above by providing a hydroforming device that will be usable also for forming large panels of sheet metal, while having relatively small dimensions and requiring a low power during the hydroforming process.

With a view to achieving said purposes, the subject of the invention is a hydroforming device having all the characteristics that have been referred to at the start and is moreover characterized in that the aforesaid hydraulic cylinder or hydraulic cylinders, with which the device and the aforesaid vertically mobile member controlled by the horizontally mobile wedge-shaped members are provided, are arranged operatively in series between one and the same die of said hydroforming module and a horizontal supporting surface of the fixed structure of the hydroforming cell, and in that said at least one hydraulic cylinder (10) is activated only for controlling a movement of the two dies (2, 3) between the open condition and the closed condition and is instead isolated with respect to its supply so as to remain blocked in a predetermined configuration during the hydroforming process, whilst said actuator means (13*a*) of the wedge-shaped members (14) are activated during the hydroforming process for applying to the two dies (2, 3) a force sufficient for preventing opening thereof during the hydroforming process, said hydraulic cylinder (10) functioning only as rigid transmission member for the application of the aforesaid force during the hydroforming process.

In the case of the present invention, means for actuating the wedge-shaped members and the aforesaid vertical hydraulic cylinder are controlled by an electronic control unit according to a predetermined sequence so that the hydraulic cylinder is used simply to bring the two dies into the condition of closing by applying only a slight force sufficient for keeping the metal element to be formed gripped between the two dies of the hydroforming module, whilst the wedge-shaped members are activated for keeping the hydroforming module in the closed condition during the process. Thanks to the transmission of the forces by means of the wedge-shaped members, the power required of the actuators that control the wedge-shaped members is sensibly low.

In fact, during the hydroforming process, the hydraulic cylinder is not supplied with fluid under pressure, but rather is simply isolated so that it will be kept blocked in a predetermined configuration thereof. In said condition, the possible slight vertical yielding that said cylinder were to undergo is in any case recovered automatically by the wedge-shaped members thanks to the arrangement in series of these with respect to the hydraulic cylinder. Once again, said wedge-shaped members are able to perform said function with a relatively low operating pressure of the fluid actuators that control them thanks to the transmission of forces that takes place through the inclined surfaces of the wedge-shaped members and the corresponding inclined surfaces of the mobile member that is controlled by them.

The subject of the present invention is also a method for hydroforming metal elements with the aid of the device described above, in which said at least one vertical hydraulic cylinder and said vertically mobile member controlled by the wedge-shaped members that are horizontally mobile are set operatively in series between one and the same die of the hydroforming module and the fixed structure of the hydroforming cell, said method being characterized in that said at least one hydraulic cylinder is activated for controlling the relative displacement of the top die and the bottom die in the closed condition and is blocked in said condition, interrupting communication between the cylinder and its means of supply during the operation of hydroforming, whilst the aforesaid means for actuating the wedge-shaped members are activated during the operation of hydroforming for keeping the wedge-shaped members in a position that prevents opening of the hydroforming module during the hydroforming process.

As already referred to above, the use of the wedge-shaped members for keeping the hydroforming module in the closed condition during the hydroforming process enables operation also on metal elements of large dimensions without rendering necessary the use of high-power actuators. Furthermore, the use of the hydraulic cylinder for the displacement of the dies between the open condition and the closed condition enables the further advantage of displacing the two dies with respect to one another also for a large travel in a short time.

BRIEF DESCRIPTION OF THE DRAWINGS

Further characteristics and advantages of the invention will emerge from the ensuing description with reference to the annexed plates of drawings, which are provided purely by way of non-limiting example and in which.

DETAILED DESCRIPTION OF THE INVENTION

Figure 1:
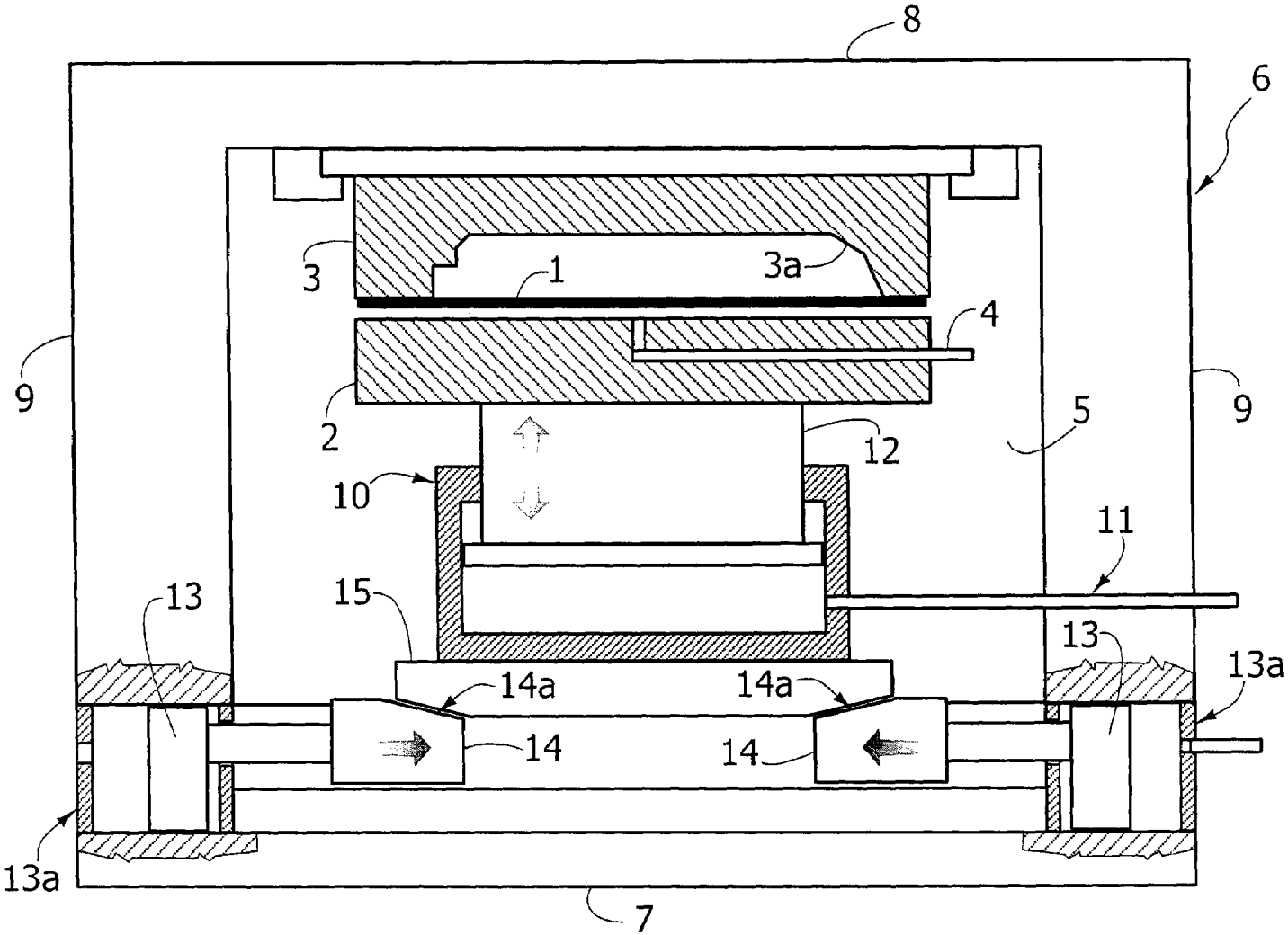
FIG. 1 is a schematic cross-sectional view of a hydroforming device according to the invention.

In FIG. 1, the reference number 1 designates as a whole a plane panel of sheet metal that is to be permanently deformed so as to assume a conformation determined by means of the hydroforming device illustrated. The metal panel 1 is set between a bottom die 2, having a top plane surface in contact with the panel 1, and a top die 3 having a shaped bottom surface 3*a* corresponding to the form desired for the panel of sheet metal 1. Water at a high pressure (for example, in the region of the 100 bar) is supplied through a pipe 4 within the chamber defined between the two dies 2, 3 so as to press the panel of sheet metal 1 against the shaped surface 3*a* of the top die 3, forcing the panel 1 to assume the desired shape. The water under pressure is supplied after the bottom and top dies 2, 3 have been firmly pressed against one another.

As already referred to above, in conventional devices, the bottom and top dies are pressed against one another by means of a press. Obviously, since the pressure of the water is relatively high, the force that must be applied by the press becomes very high when the panel of sheet metal is of relatively wide dimensions, such as for example in the case of a panel of the structure of a motor-vehicle body. Consequently, the known devices entail the use of presses of very large dimensions and high power.

In the case of the device of the invention, both the two dies 2, 3, and the means designed to press them against one another are contained within the cavity 5 of a hydroforming cell having a rigid metal structure 6 in the form of a box (FIG. 2) having a base 7, a top cross member 8 surmounted by the base 7 and set at a distance therefrom, and two vertical shoulders 9, which join the cross member 8 rigidly to the base 7. Consequently, the vertical forces that are generated during the hydroforming process are discharged onto the shoulders 9 of the structure 6, which are subject to tensile stress.

Furthermore, in the device according to the invention, the two dies 2, 3 can be displaced vertically between an open condition and a closed condition by means of a hydraulic cylinder 10, which is supplied with oil under pressure through a pipe 11 so as to press with its stem 12 the bottom die 2 against the top die 3, which is rigidly connected to the top cross member 8. In the example illustrated (see FIG. 1), the top die 3 is supported by the cross member 8 by means of side brackets, within which it is guided like a drawer to enable the replacement of the top die 3, according to the piece on which it is necessary to work, and consequently the conformation of the surface of forming 3*a* that it is necessary to provide.

The pressure applied by the hydraulic cylinder 10 is only the one required for displacing the two dies 2, 3 from their open position to their closed position and to press them lightly against one another so as to grip the panel of sheet metal 1 between them. The force necessary for preventing the two dies 2, 3 from displacing from their closed condition during the hydroforming process, when water at a high pressure is supplied through the pipe 4 into the forming chamber, is obtained by means of two horizontal hydraulic cylinders 13*a*, which are incorporated in the fixed rigid structure 6 of the hydroforming cell. The two hydraulic cylinders 13*a* have pistons 13, the stems of which push two wedge-shaped members 14 that are guided over a horizontal supporting surface of the base 7. The two wedge-shaped members 14 move synchronously in mutually opposite directions, with their top inclined surfaces 14*a* in sliding contact with the corresponding inclined surfaces of a plate 15, on which the hydraulic cylinder 10 is mounted. When the two hydraulic cylinders 13*a*, which function as means for actuating the wedge-shaped members 14, are activated, the two wedge-shaped members 14 convert the force applied horizontally by the hydraulic cylinders 13*a* into a vertical force that is transmitted to the bottom die 2 through the bottom plate 15 and the hydraulic cylinder 10. In said step, the communication of the active chamber of the cylinder 10 with the corresponding supply is interrupted, by valve means (not illustrated) forming part of the control circuit 11*a* for controlling the supply of the cylinder 10 (illustrated in FIG. 2). Consequently, in said condition the relative position between the body of the cylinder 10 and its stem 12 does not change substantially so that the cylinder 10 acts simply as transmission element set between the bottom plate 15, subject to the thrust of the wedge-shaped members 14, and the bottom die 2, subject to the thrust generated by the pressure of the water in the forming chamber. Thanks to the effect of the inclined surfaces of the wedge-shaped elements 14*a* and of the bottom plate 15, the force necessary for preventing opening of the two dies 2, 3 during the hydroforming process can hence be obtained with actuators 13*a* of relatively low power. During the step of hydroforming, any possible slight yielding, to which the cylinder 10 were to be subject, is in any case recovered automatically by the two wedge-shaped members 14. As already referred to above, moreover, the cylinder 10 in said condition is completely isolated from the outside world, whilst it is activated only before and after the step of hydroforming for closing and opening, respectively, the two dies 2, 3.

Figure 2:
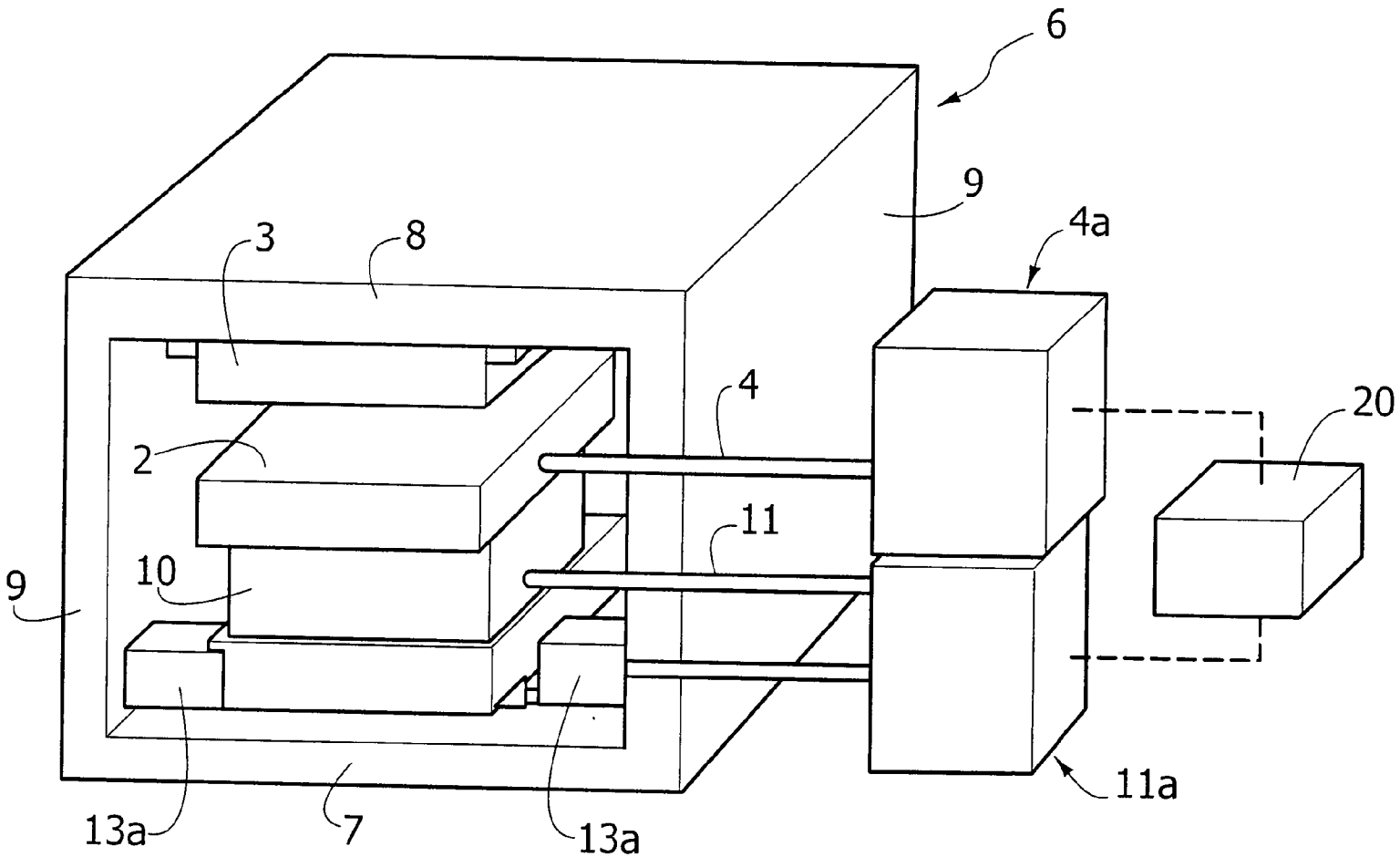
FIG. 2 is a schematic perspective view of the device of FIG. 1.

In FIG. 2, the reference number 4*a* designates as a whole the supply circuit of the pipe 4, which carries water under pressure to the hydroforming chamber. Both the circuit 11*a* for controlling the cylinder 10 and the circuit 11*a* that controls the hydraulic cylinder 10 and the actuator 13*a* of the two wedge-shaped members 14 include solenoid valves (not illustrated), which are controlled by an electronic control unit 20 (FIG. 2) according to the desired sequence.

Of course, without prejudice to the principle of the invention, the details of construction and the embodiments may vary widely with respect to what is described and illustrated purely by way of example, without thereby departing from the scope of the present invention.

What is claimed is:

1. A device for hydroforming metal elements, comprising:

a hydroforming cell having a fixed rigid structure including:

a base;

a top cross member surmounting the base and set at a distance therefrom; and two shoulders, which connect the top cross member rigidly to the base; and a hydroforming module, set within the cell between the base and said top cross member so that vertical forces that are generated during a hydroforming process are discharged on said shoulders, which are thus subject to tensile stress, said hydroforming module comprising:

a top die and a bottom die, which can be displaced vertically with respect to one another between an open condition and a closed condition in which they define between them a forming cavity for a metal element, set between them;

means for supplying a liquid under pressure within said forming cavity; and means for controlling a relative vertical movement of the two dies, said means comprising:

at least one hydraulic cylinder, set between one of said dies and the fixed structure; and a vertically mobile member operatively connected to one of said two dies, a pair of wedge-shaped members set opposite to one another, which can be displaced synchronously by means of actuator means in a horizontal direction over a horizontal supporting surface of the fixed structure of the hydroforming cell and having inclined surfaces co-operating with corresponding inclined surfaces of said vertically mobile member, said vertically mobile member controlled by said wedge-shaped members which are horizontally mobile said at least one hydraulic cylinder and said vertically mobile member located between one die of said two dies of the hydroforming module and the fixed structure of said hydroforming cell, and control means prearranged so that said at least one hydraulic cylinder is activated only for controlling a movement of the two dies between the open condition and the closed condition, and said at least one hydraulic cylinder isolated with respect to a supply of hydraulic fluid so as to remain fixed at a desired size during the hydroforming process, said means for actuating the wedge-shaped members activated during the hydroforming process for applying to the two dies a force sufficient for preventing opening of said two dies during the hydroforming process, said at least one hydraulic cylinder functioning as a rigid transmission member for application of said force from the wedge-shaped members to the dies during the hydroforming process.

2. The device according to claim 1, wherein said at least one hydraulic cylinder is set between one die of said two dies and the vertically mobile member and said wedge-shaped members are set between said vertically mobile member and a horizontal supporting surface of the fixed structure of the hydroforming cell.

3. The device according to claim 2, wherein said top die is rigidly connected to the top cross member of the fixed structure of the hydroforming cell, and said bottom die is operatively connected to a mobile stem of said at least one hydraulic cylinder.

4. The device according to claim 1, wherein said at least one hydraulic cylinder maintains a substantially same length in a direction between said base and said two dies during the hydroforming process.

5. The device according to claim 1, wherein said at least one hydraulic cylinder comprises a body and a stem, said stem avoiding movement relative to said body during the hydroforming process.

6. A method for hydroforming metal elements comprising:

providing a hydroforming cell having a fixed rigid structure including:

a base;

a top cross member surmounting the base and set at a distance therefrom;

two shoulders, which connect the top cross member rigidly to the base; and providing a hydroforming module set within the cell between said base and said top cross member so that vertical forces that are generated during the hydroforming process are discharged on said shoulders, which are thus subject to tensile stress, said hydroforming module comprising:

a top die and a bottom die, which can be displaced vertically with respect to one another between an open condition and a closed condition, in which they define between them a forming cavity for a metal element, set between them, in which a liquid is supplied under pressure within said forming cavity, and providing prearranged means for controlling a relative vertical movement of the two dies, said means including:

at least one vertical hydraulic cylinder, set between one of said dies and the fixed structure of the cell; and a pair of wedge-shaped members set opposite to one another, which can be displaced synchronously by means of actuator means in a horizontal direction over a horizontal supporting surface of the fixed structure of the cell and having inclined surfaces in sliding contact with corresponding inclined surfaces of a vertically mobile member, which is operatively connected to one of said dies, controlling said vertically mobile member by said wedge-shaped members, said at least one hydraulic cylinder and said vertically mobile member located between one die of said dies of the hydroforming module and a supporting surface of the fixed structure of the hydroforming cell, and activating said at least one hydraulic cylinder only for controlling a movement of the two dies between the open condition and the closed condition and isolating said at least one hydraulic cylinder with respect to a supply of hydraulic fluid so as to remain fixed at a desired size during the hydroforming process, and activating said means for actuating the wedge-shaped members during the hydroforming process to apply to the two dies a force sufficient for preventing opening of the two dies during the hydroforming process, said at least one hydraulic cylinder functioning as a rigid transmission member for the application of said force from the wedge-shaped members to the dies during the hydroforming process.

7. The method according to claim 6, wherein said at least one hydraulic cylinder maintains a substantially same length in a direction between said base and said two dies during the hydroforming process.

8. The method according to claim 6, wherein said at least one hydraulic cylinder comprises a body and a stem, said stem avoiding movement relative to said body during the hydroforming process.

* * * * *

UNITED STATES PATENT AND TRADEMARK OFFICE

CERTIFICATE OF CORRECTION

PATENT NO. : 7,530,247 B2
APPLICATION NO. : 12/117511
DATED : May 12, 2009
INVENTOR(S) : Lai et al.

It is certified that error appears in the above-identified patent and that said Letters Patent is hereby corrected as shown below:

Claim 6, Col. 6, Lines 31-40: Delete
"a top die and a bottom die, which can be displaced verticalcally with respect to one another between an open condition and a closed condition, in which they define between them a formig cavity for a metal element, set between them,
in which a liquid is supplied under pressure with said forming cavity, and providing prearranged means for controlling a relative vertical movement of the two"

and insert
-- a top die and a bottom die, which can be displaced vertically with respect to one another between an open condition and a closed condition, in which they define between them a forming cavity for a metal element, set between them,
in which a liquid is supplied under pressure with said forming cavity, and
providing prearranged means for controlling a relative vertical movement of the two --

Signed and Sealed this

Eighteenth Day of August, 2009

David J. Kappos

David J. Kappos
*Director of the United States Patent and Trademark Office*